US011732396B2

(12) United States Patent
Gonzaga et al.

(10) Patent No.: US 11,732,396 B2
(45) **Date of Patent: *Aug. 22, 2023**

(54) LAUNDRY TREATING APPLIANCE AND METHOD OF CONTROL

(71) Applicant: WHIRLPOOL CORPORATION, Benton Harbor, MI (US)

(72) Inventors: Emmanuel F. Gonzaga, Rio Claro (BR); Fernando Raiss Martins, Rio Claro (BR)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/872,297

(22) Filed: Jul. 25, 2022

(65) Prior Publication Data

US 2022/0356629 A1 Nov. 10, 2022

Related U.S. Application Data

(60) Continuation of application No. 16/845,423, filed on Apr. 10, 2020, now Pat. No. 11,414,806, which is a division of application No. 15/651,624, filed on Jul. 17, 2017, now Pat. No. 10,648,120.

(51) Int. Cl.

| | |
|---|---|
| ***D06F 39/02*** | (2006.01) |
| ***D06F 13/00*** | (2006.01) |
| *D06F 23/04* | (2006.01) |
| *D06F 37/16* | (2006.01) |
| *D06F 37/12* | (2006.01) |

(52) U.S. Cl.

CPC ..... *D06F 39/02* (2013.01); *D06F 13/00* (2013.01); *D06F 23/04* (2013.01); *D06F 37/12* (2013.01); *D06F 37/16* (2013.01)

(58) Field of Classification Search

CPC ..... D06F 39/02; D06F 39/022; D06F 39/024; D06F 13/00; D06F 13/02; D06F 37/12; D06F 37/30; D06F 31/00; D06F 21/00; D06F 21/06; D06F 21/08; D06F 21/10; D06F 23/00; D06F 23/04; D06F 23/06; D06F 23/065

See application file for complete search history.

(56) References Cited

U.S. PATENT DOCUMENTS

| | | | |
|---|---|---|---|
| 1,795,395 | A | 3/1931 | Hoke |
| 2,019,089 | A | 10/1935 | Papworth |
| 2,218,275 | A | 10/1940 | Woodin |
| 2,748,788 | A | 6/1956 | Duckstein |
| 2,949,025 | A | 8/1960 | Tingley, Jr. |

(Continued)

FOREIGN PATENT DOCUMENTS

| | | |
|---|---|---|
| BR | D17003246-7 | 10/2011 |
| BR | 102013015674 A2 | 7/2015 |

(Continued)

*Primary Examiner* — David G Cormier

(74) *Attorney, Agent, or Firm* — McGarry Bair PC

(57) ABSTRACT

A method and apparatus for a laundry treating appliance dispense treating chemistry into a rotating basket. A dispenser can be a centrifugal dispenser adapted to move or dispense treating chemistry based upon rotational movement of a basket. The dispenser can include a holding pocket to hold a volume of treating chemistry, a transferring pocket to centrifugally receive the treating chemistry, and a dilution pocket to dilute the treating chemistry and dispenser the treating chemistry.

20 Claims, 7 Drawing Sheets

(56) References Cited

U.S. PATENT DOCUMENTS

| | | | |
|---|---|---|---|
| 3,014,358 | A | 12/1961 | Bochan |
| 3,026,699 | A | 3/1962 | Rhodes |
| 3,029,623 | A | 4/1962 | Morey |
| 3,145,551 | A | 8/1964 | Ziegler |
| 3,209,560 | A | 10/1965 | Shelton |
| 3,324,688 | A | 6/1967 | Hubbard |
| 3,481,162 | A | 12/1969 | Ziegler |
| 3,509,741 | A | 5/1970 | Morey |
| 3,575,020 | A | 4/1971 | Hubbard |
| 3,648,486 | A | 3/1972 | Rosinski, Jr. et al. |
| 3,736,773 | A | 6/1973 | Waugh |
| 3,987,652 | A | 10/1976 | Ruble |
| 4,118,957 | A | 10/1978 | Marcussen |
| 4,162,621 | A | 7/1979 | Stone |
| 4,175,409 | A | 11/1979 | Morey |
| 4,186,573 | A | 2/1980 | Brenner et al. |
| 4,207,760 | A | 6/1980 | Bochan |
| 4,225,992 | A | 10/1980 | Morey |
| 4,338,802 | A | 7/1982 | Ohmann et al. |
| 4,417,457 | A | 11/1983 | Brenner |
| 4,502,303 | A | 3/1985 | Wasemann |
| 4,637,230 | A | 1/1987 | Roberts |
| 4,637,231 | A | 1/1987 | McMillan et al. |
| 4,920,770 | A | 5/1990 | Dooley et al. |
| 5,113,542 | A | 5/1992 | Pastryk et al. |
| 5,440,903 | A | 8/1995 | Kropf et al. |
| 5,497,638 | A | 3/1996 | Berkcan et al. |
| 5,500,967 | A | 3/1996 | Wilson et al. |
| 5,611,221 | A | 3/1997 | Tremel |
| 5,651,277 | A | 7/1997 | Richardson |
| 5,689,847 | A | 11/1997 | Tremel et al. |
| 5,784,902 | A | 7/1998 | Pinkowski et al. |
| 5,855,127 | A | 1/1999 | Kohara et al. |
| 6,460,382 | B1 | 10/2002 | Kim et al. |
| 7,401,479 | B2 | 7/2008 | Fields |
| 7,866,191 | B2 | 1/2011 | Turner et al. |
| 9,091,013 | B2 | 7/2015 | Kim et al. |
| 9,404,213 | B2 | 8/2016 | Kappler |
| 2004/0116267 | A1 | 6/2004 | Mathieu et al. |
| 2005/0284197 | A1 | 12/2005 | Pinkowski et al. |
| 2007/0084254 | A1 | 4/2007 | Messina |
| 2007/0199664 | A1 | 8/2007 | Zacher et al. |
| 2007/0241938 | A1 | 10/2007 | Ulius-Sabel et al. |
| 2008/0312773 | A1 | 12/2008 | Nag |
| 2009/0211108 | A1 | 8/2009 | Moschutz et al. |
| 2009/0293203 | A1 | 12/2009 | Hettinger et al. |
| 2010/0326141 | A1 | 12/2010 | Chung |
| 2011/0094902 | A1 | 4/2011 | Delehey et al. |
| 2013/0276483 | A1 | 10/2013 | Ryu et al. |
| 2013/0312462 | A1 | 11/2013 | Kim et al. |
| 2015/0059417 | A1 | 3/2015 | Ramasco |
| 2015/0184326 | A1 | 7/2015 | Seo et al. |
| 2015/0211163 | A1 | 7/2015 | Kim et al. |
| 2016/0201243 | A1 | 7/2016 | Bergamo |
| 2016/0222567 | A1 | 8/2016 | Ramasco et al. |
| 2016/0289884 | A1 | 10/2016 | Kim et al. |
| 2016/0296865 | A1 | 10/2016 | Blanks et al. |
| 2018/0237972 | A1 | 8/2018 | Lv et al. |
| 2018/0371668 | A1 | 12/2018 | Yonezawa et al. |
| 2019/0186064 | A1 | 6/2019 | Kim et al. |

FOREIGN PATENT DOCUMENTS

| | | | |
|---|---|---|---|
| BR | 102013018364 | A2 | 8/2015 |
| BR | 102013021866 | A2 | 8/2015 |
| BR | 102013015672 | A2 | 9/2015 |
| BR | 102013027400 | A2 | 9/2015 |
| BR | 102013025343 | A2 | 11/2015 |
| BR | 102014008903 | A2 | 12/2015 |
| BR | 102014010905 | A2 | 12/2015 |
| BR | 102014010908 | A2 | 12/2015 |
| BR | 102014018397 | A2 | 2/2016 |
| CN | 203530690 | U | 4/2014 |
| CN | 203729101 | U | 7/2014 |
| CN | 105220395 | A | 1/2016 |
| KR | 20030004708 | | 1/2003 |
| KR | 20030045447 | A | 6/2003 |
| KR | 20150077264 | A | 7/2015 |
| WO | 2006087735 | A1 | 8/2006 |
| WO | 2013088426 | A2 | 6/2013 |
| WO | 2014201534 | A1 | 12/2014 |
| WO | 2015048870 | A1 | 4/2015 |
| WO | 2015058269 | A1 | 4/2015 |

46

LAUNDRY TREATING APPLIANCE AND METHOD OF CONTROL

CROSS REFERENCE TO RELATED APPLICATION(S)

This application is a continuation of U.S. patent application Ser. No. 16/845,423, filed Apr. 10, 2020, now U.S. Pat. No. 11,414,806, issued Aug. 16, 2022, which is a divisional of U.S. patent application Ser. No. 15/651,624, filed Jul. 17, 2017, now U.S. Pat. No. 10,648,120, issued May 12, 2020, all of which are incorporated herein by reference in their entirety.

BACKGROUND

Laundry treating appliances, such as clothes washers, refreshers, and non-aqueous systems, can have a configuration based on a rotating drum that defines a treating chamber in which laundry items are placed for treating. The laundry treating appliance can have a controller that implements a number of pre-programmed cycles of operation having one or more operating parameters. The controller can control a motor to rotate the drum according to one of the pre-programmed cycles of operation. The controller can control the motor to rotate the drum at the same speeds for a give pre-programmed cycle of operation regardless of the characteristics of the laundry items or changes in the system.

DETAILED DESCRIPTION

Aspects of the disclosure relate to a laundry treating appliance including a dual-basket system including a first basket and an optional, removable basket assembly having a second basket. A first laundry treating chamber is formed by the first basket and a second laundry treating chamber is formed by the second basket. A cycle of operation can be used to treat laundry articles within one or more of the first or second treating chambers. Separate dispensers can be dedicated for each of the first and second basket, in order to properly treat different articles provided within the separate baskets. A dedicated centrifugal dispenser can be utilized with the second basket for dispensing particular treating chemistries solely to the second treating chamber.

In the situation where the dual-basket system is utilizing the optional, removable second basket, a user can provide particular treating chemistries to the second basket alone, particularly tailored to treat the laundry within the second basket. A separate dispenser can be used to treat any clothing articles in the first basket. The second basket can be imperforate and filled with a volume of water to treat any articles. As some treating chemistries are detrimental if provided directly to clothing or similar articles, such as fabric softener, an intuitive dispenser is required to mix the treating chemistry with a volume of water prior to application to the articles of laundry, while remaining dedicated to the second basket.

A centrifugal dispenser can be coupled to the second basket to selectively dispense a volume of treating chemistry to be mixed with a volume of water within the centrifugal dispenser prior to application to the load of laundry. The centrifugal dispenser provides for delayed dispensing of the treating chemistry until after a wash cycle and an initial spin cycle, while mixing the volume of treating chemistry, such as fabric softener, with water prior to application to the laundry.

Figure 1:
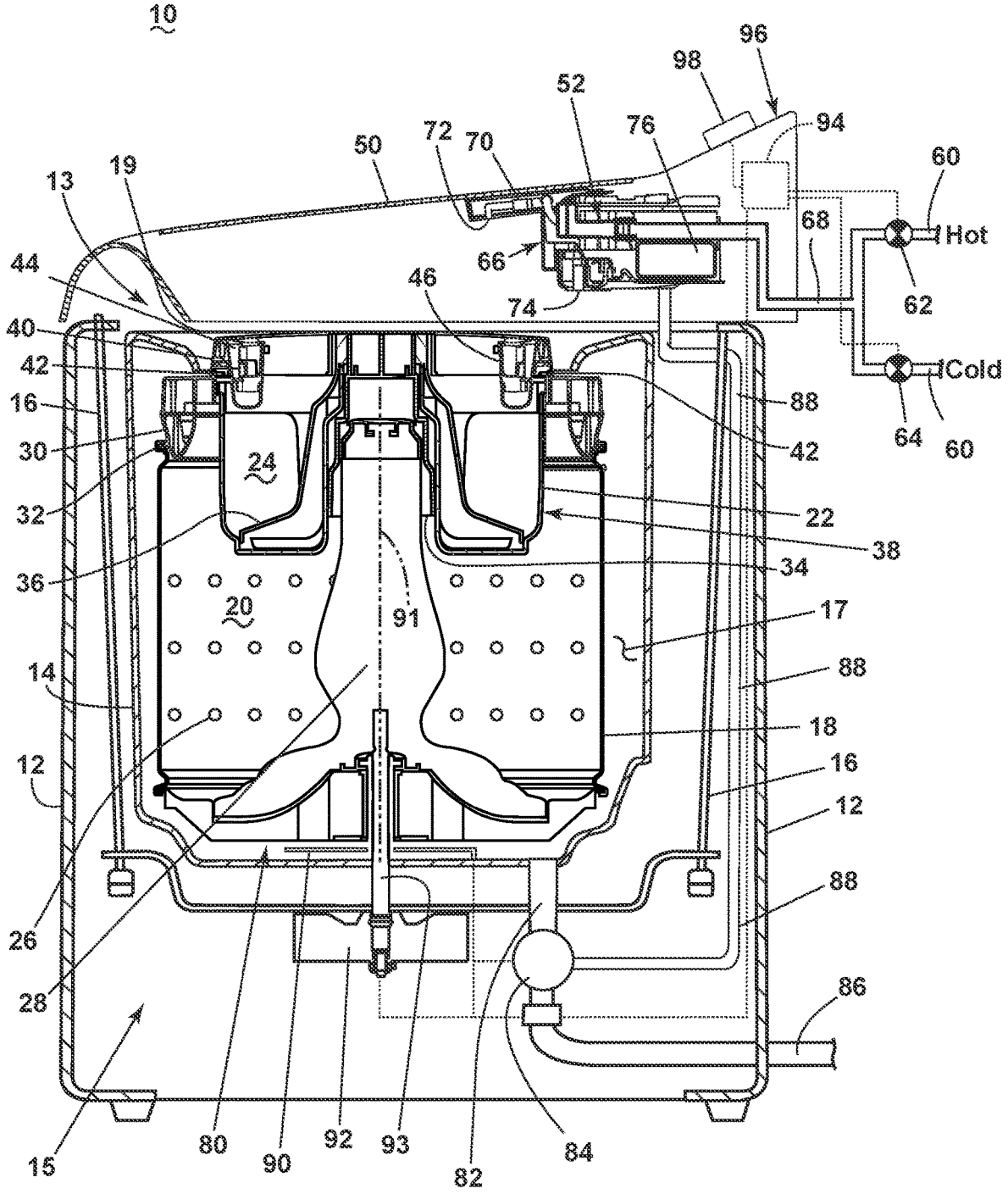
FIG. 1 is a schematic view of a laundry treating appliance in the form of a washing machine having a first basket and a second basket.

Referring now to FIG. 1 a laundry treating appliance 10 can be any appliance that performs a cycle of operation to clean or otherwise treat items or articles placed therein, such as clothing laundry in one non-limiting example. The laundry treating appliance 10 is illustrated as a washing machine, which can include a structural support system comprising a cabinet 12, which defines a housing within which a laundry holding system resides. The cabinet 12 can be a housing having a chassis and/or a frame, defining an access opening 13 and an interior 15 and enclosing components typically found in a conventional washing machine, such as motors, pumps, fluid lines, controls, sensors, transducers, and the like. Such components will not be described further herein except as necessary for a complete understanding of the invention.

The laundry treating appliance 10 includes a tub 14 defining a liquid chamber 17 having a first open top 19 facing the access opening 13. A suitable suspension system 16 dynamically suspends portions of the laundry treating appliance 10 within the cabinet 12. A first basket 18 is provided within the tub 14 and defines a first treating chamber 20. A treating chamber as used herein can be used interchangeably with the term laundry chamber or laundry treating chamber, and can mean any defined space adapted to hold laundry articles for treatment according to a cycle of operation. The first basket 18 can include a second open top facing the first open top 19 of the tub 14. The first basket 18 can include a plurality of perforations 26 such that liquid can flow between the tub 14 and the first basket 18 through the perforations 26. A first clothes mover 28 is provided in the first treating chamber 20 to move or agitate laundry articles received in the first treating chamber 20 according to a cycle of operation. Clothes mover as used herein can mean any suitable clothes mover to impart mechanical energy to a load of laundry, such as an agitator, mover, blade, impeller, or auger in non-limiting examples. A balance ring 30 can be provided along an upper edge 32 of the first basket 18.

A removable basket assembly 38 can include a second basket 22 having a third open top that faces the first open top, and is at least partially provided within the first basket 18. The second basket defines a second treating chamber 24 at least partially provided within the first treating chamber 20. A transmitter 34 can be included in the removable basket assembly 38 and can removably attach to the first clothes mover 28. The transmitter 34 facilitates attachment and removal of the removable basket assembly 38 to and from the first clothes mover 28 to position the second basket 22 at least partially within the first treating chamber 20. A second clothes mover 36 is provided within the second basket 22 and is coupled with the first clothes mover 28 via the transmitter 34.

An upper ring 40 can be included in the removable basket assembly 38 and can operably couple to the second basket 22. The upper ring 40 can include an outer diameter that is greater than a diameter of the second basket 22. The upper ring 40 can extend at least partially over and seat upon the balance ring 30, such that the balance ring 30 can at least partially support the removable basket assembly 38 at the upper ring 40. A set of outlets 42 can be provided in the upper ring 40 to provide egress for liquid from the second basket 22. A set as used herein can include any number of elements, including only one. A detergent dispenser 44 and a fabric softener dispenser 46 can mount along the interior of the upper ring 40 and extend into the second treating chamber 24. Furthermore, the upper ring 40 can partially form the dispensers 44, 46. While the dispensers 44, 46 are described as specific to detergent and fabric softener, the dispensers 44, 46 can be used for dispensing any suitable treating chemistry into the second basket 22, which can be particular to a cycle of operation, including but not limited to water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof. In one non-limiting example, the detergent dispenser 44 can be a dispenser as disclosed in U.S. Pub. No. 2015/0059417 to Ramasco, filed Aug. 27, 2014, now abandoned, entitled "Valved Dispensing System for Products in Liquid Form by Inertial Centrifugal Action for Household Appliances," which is herein incorporated by reference in full.

The removable basket assembly 38 can further include coupling elements disposed on the periphery of the second basket 22. Such coupling elements can couple the removable basket assembly 38 to the first basket 18 and permit common rotation among the two. In one non-limiting example, the coupling elements can be similar to those as disclosed in U.S. Pub. No. 2016/0222567 to Ramasco et al., filed Oct. 23, 2015, now U.S. Pat. No. 9,863,078, issued Jan. 9, 2018, entitled "Coupling System of Removable Compartment for Appliances," which is herein incorporated by reference in full, and the removable basket assembly 38 can couple in the same manner as described therein.

It should be appreciated that the removable basket assembly 38 is removable from the laundry treating appliance 10, such that the laundry treating appliance 10 can be used with or without the removable basket assembly 38. The balance ring 30 on the first basket 18 and the transmitter 34 coupled to the first clothes mover 28 are used to support the removable basket assembly 38.

The laundry treating appliance 10 can further include a door 50, which can be movably mounted to the cabinet 12 to selectively close the tub 14, the first basket 18, or the second basket 22. The laundry treating appliance 10 can further include a liquid supply system 52 for supplying water to the laundry treating appliance 10 for use in treating laundry during a cycle of operation. The liquid supply system 52 can include a source of water, such as a household water supply 60, which can include separate valves 62 and 64 for controlling the flow of hot and cold water, respectively. Water can be supplied to a liquid manifold 66 via a supply conduit 68. Optionally, one or more additional valves can be included on the supply conduit 68 to selectively provide water to the liquid manifold 66, or to tailor water temperature from the household water supply 60. Such tailoring can be specific to either basket 18, 22. A water dispenser 70, fluidly coupled to the liquid manifold 66, can mount to the door 50, for providing water to one or more of the first and second baskets 18, 22 via a first outlet 72. The water dispenser 70 can overhang above the first and second baskets 18, 22 such that water dispensed from the first outlet 72 can pass into the second basket 22 when using the removable basket assembly 38, or into the first basket 22 when the removable basket assembly 38 is not being used. A second outlet 74 can be provided on the liquid manifold 66 dedicated to the first basket 18. The second outlet 74 can be positioned outside of the second basket 22, such that any dispensed water will pass into the space between the tub 14 and the upper ring 40, passing into the first treating chamber 20, but not into the second treating chamber 24. The water dispenser 70 can be dedicated to the removable basket assembly and the second outlet 74 can be dedicated to the first basket 18; however, the laundry treating appliance 10 should not be so limited.

A dispenser 76 can be provided within or adjacent to the liquid manifold 66 and in fluid communication with the liquid manifold 66. The dispenser 76 can be used to dispense treating chemistry to the first basket 18 through the second outlet 74. Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The laundry treating appliance 10 can also include a recirculation and drain system for recirculating or draining liquid within the laundry treating appliance 10. Liquid supplied to the tub 14 typically enters a space between the tub 14 and the first basket 18 and can flow by gravity to a sump 80 formed in part by a lower portion of the tub 14. The sump 80 can also be formed by a sump conduit 82 that can fluidly couple the lower portion of the tub 14 to a pump 84. The pump 84 can direct liquid to a drain conduit 86, which can drain the liquid from the laundry treating appliance 10, or to a recirculation conduit 88, which can direct the liquid from the sump conduit 82 into the liquid manifold 66, which can be returned to one or more of the first or second treating chambers 20, 24. In this manner, liquid provided to the tub 14, with or without treating chemistry can be recirculated into either the first or second treating chambers 20, 24 for treating the laundry per one or more cycles of operation.

The liquid supply and/or recirculation and drain system can be provided with a heating system which can include one or more devices for heating laundry and/or liquid supplied to the tub 14, such as a sump heater 90, which can be used to heat the laundry and/or liquid within the tub 14 as part of a cycle of operation.

Additionally, the liquid supply, recirculation and drain system can differ from the configuration shown in FIG. 1, such as by inclusion of other valves, conduits, treating chemistry dispensers, sensors, such as water level sensors and temperature sensors, and the like, to control the flow of liquid through the laundry treating appliance 10 and for the introduction of more than one type of treating chemistry.

The laundry treating appliance 10 also includes a drive system for rotating the first and second baskets 18, 22 within the tub 14. The drive system can include a motor 92, which can be directly coupled with the first basket 18 and the first clothes mover 28 through a drive shaft 93 to rotate or reciprocate the first basket 18 or the first clothes mover 28 about a rotational axis 91 during a cycle of operation. The drive shaft 93 can define the rotational axis 91. The motor 92 couples to the baskets 18, 22 via the drive shaft 93 to rotate the baskets 18, 22 about the rotational axis 91 about which the first and second baskets 18, 22 and the first and second clothes movers 28, 36 can rotate. As such, the motor is drivingly coupled to the baskets 18, 22 to rotate the baskets. The rotational movement of the first clothes mover 28 can be imparted to the second clothes mover 36 and rotational movement of the first basket 18 can be imparted to the second basket 22. The motor 92, in one non-limiting example, can be a brushless permanent magnet (BPM) motor. Other motors, such as an induction motor or a permanent split capacitor (PSC) motor, can also be used. The motor 92 can rotate the first basket 18 and the second basket 22 at various speeds in either rotational direction, and can reciprocate the first and second clothes movers 28, 36 within its respective basket.

The laundry treating appliance 10 also includes a control system for controlling the operation of the laundry treating appliance 10 to implement one or more cycles of operation. The control system can include a controller 94 located within the cabinet 12 and a user interface 96 that is operably coupled with the controller 94. The controller 94 operably couples to the liquid supply system 52 and the user interface 96. The user interface 96 is configured to receive input from a user and provide output to the user. Such input can be used to select a cycle of operation, for example, and output can include information related to the cycle of operation, such as status. The input can be communicated to the controller 94, indicative of and including instructions to execute the cycle of operation. The user interface 96 can include one or more knobs 98, dials, switches, displays, touch screens and the like for communicating with the user, such as to receive input and provide output. The user can enter different types of information including, without limitation, cycle selection and cycle parameters, such as cycle options.

The controller 94 can include the machine controller and any additional controllers provided for controlling any of the components of the laundry treating appliance 10. For example, the controller 94 can include the machine controller and a motor controller. It is contemplated that the controller 94 is a microprocessor-based controller that implements control software and sends/receives one or more electrical signals to/from each of the various working components to effect the control software.

Figure 2:
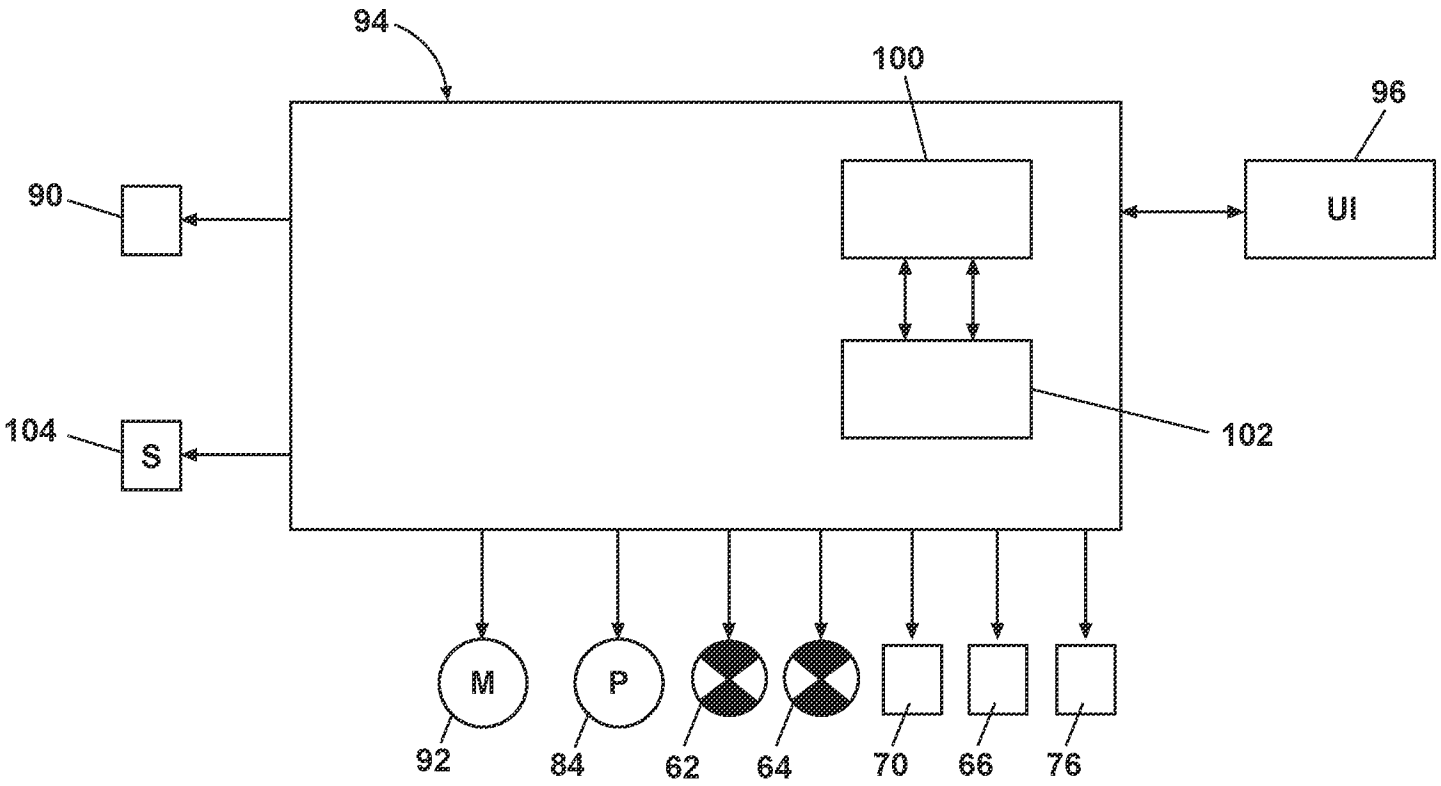
FIG. 2 is a schematic of a control system of the laundry treating appliance of FIG. 1.

Referring to FIG. 2, the controller 94 can be provided with a memory 100 and a central processing unit (CPU) 102. The memory 100 can be used for storing the control software that is executed by the CPU 102 in completing a cycle of operation using the laundry treating appliance 10 and any additional software. Examples, without limitation, of cycles of operation include: wash, heavy duty wash, delicate wash, quick wash, pre-wash, refresh, rinse only, and timed wash.

The controller 94 can be operably coupled with one or more components of the laundry treating appliance 10 for communicating with and controlling the operation of the component to complete a cycle of operation. For example, the controller 94 can be operably coupled with the motor 92, the pump 84, the liquid manifold 66, the water dispenser 70, the dispenser 76, the sump heater 90 which can be provided throughout the laundry treating appliance 10 to implement the operation of these and other components to implement one or more of the cycles of operation. Additional instruction or communication can be sent to or received from a user through the user interface 96.

The controller 94 can also be coupled with one or more sensors 104 provided in one or more of the systems of the laundry treating appliance 10 to receive input from the sensors, which are known in the art and not shown for simplicity. Non-limiting examples of sensors 104 that can be communicably coupled with the controller 94 include: a treating chamber temperature sensor, a moisture sensor, a weight sensor, a chemical sensor, a position sensor and a motor torque sensor, which can be used to determine a variety of system and laundry characteristics, such as laundry load inertia or mass. One particular sensor can be a position sensor to determine whether the removable basket assembly 38 is positioned within the laundry treating appliance 10. Another particular sensor can be a flow meter, which can be used to measure and control the amount of water filling the removable basket assembly 38. The flow meter could minimize or prevent the occurrence of water leaving the removable basket assembly 38 during the filling phase, and minimize contamination potential with the first basket 18. Yet another particular sensor can include a sensor for determining the presence of the removable basket assembly 38. Additionally, detection of the removable basket assembly 38 can be detected in a manner disclosed in U.S. Pat. Pub. No. 2016/0201243 to Bergamo, filed Oct. 23, 2015, now U.S. Pat. No. 9,777,419, issued Oct. 3, 2017, entitled "Detection System of Washing Machines Removable Basket and Method for Detection of Washing Machines Removable Basket," which is herein incorporated by reference in full.

The laundry treating appliance 10 can be operated with both the first basket 18 and the second basket 22, simultaneously, or can be operated with either the first basket 18 or the second basket 22 individually. When executing a cycle of operation within the first basket 18 without the removable basket assembly 38, the second basket 22, including the transmitter 34, can be removed from the laundry treating appliance 10. When using the removable basket assembly 38 alone, laundry articles need to be provided only in the second basket 22. In such an organization, the removable basket assembly 38 mounts on the first clothes mover 28. Rotational or reciprocating movement of the first clothes mover 28 is transferred to the second clothes mover 36 via the transmitter 34. When using both the first and second baskets 18, 22, the first basket 18 can be filled with laundry articles, then the removable basket assembly 38 installs over the first treating chamber 20, and the second basket 22 is filled with additional laundry articles. The reverse of the aforementioned process can be used to remove laundry articles after a cycle of operation has completed.

In operation using both the removable basket assembly 38 and the first basket 18, treating chemistry can be provided in one or more of the dispensers 44, 46, 76, to treat the laundry articles according to a desired cycle of operation. A user can select a cycle of operation on the user interface 96, such as a standard wash cycle of operation. Different cycles of operation can be tailored to different or individual treating chambers, as well as different organizations, such as with or without the removable basket assembly 38. Water can fill the first basket 18 dispensed from the second outlet 74 and passing to fill the tub 14, and then filling the first basket 18 through the perforations 26. Water can simultaneously fill the second basket 22 dispensed from the first outlet 72 of the water dispenser 70. Detergent can be dispensed into the first treating chamber 20 from the dispenser 76 in the liquid manifold 66 and can be dispensed into the second treating chamber 24 from the dispensers 44, 46 on the upper ring 40. The first and second clothes movers 28, 36 can agitate the articles within the first and second treating chambers 20, 24, respectively. Rotational or reciprocating movement of the first clothes mover 28 is translated to the second clothes mover 36 via the transmitter 34. After completion of the wash cycle, the liquid can drain from the first treating chamber 20 into the tub 14. The motor 92 can then rotate the first basket 18 and impart rotational movement to the second basket 22. The rotational movement of the second basket 22 can drive liquid within the second basket 22 outward and upward toward the outlets 42, where water can drain over the balance ring 30 and into the tub 14 exterior of the first basket 18. The liquid can drain from the laundry treating appliance 10 through the drain conduit 86. A rinse cycle can then begin, refilling both the first and second treating chambers 20, 24 in the same manner as the wash cycle. The water can be again drained and a spin cycle can begin. Rotational movement is transferred from the motor to the second basket 22 via the first basket 18. Liquid can drain from the first and second treating chamber 20, 24 in the same manner as draining the wash cycle. As such, the first and second treating chambers 20, 24 can treat two individual loads of articles separately, but simultaneously.

Alternatively, the second basket 22 can be used alone. The operation can be similar to that described above, without filling, draining, or treating any articles within the first treating chamber 20. Rotational or reciprocating movement is still imparted to the first basket 18 and the first clothes mover 28, which is transferred to the second basket 22 and the second clothes mover 36, respectively, in order to treat articles in the second basket 22.

Alternatively, the first basket 18 can be used alone. The removable basket assembly 38 can be removed and the first basket 18 can treat a load of laundry in a manner similar to that of a traditional laundry treating appliance 10. In yet another alternative, the removable basket assembly 38 can remain on top of the first basket 18, and the first treating chamber 20 can be used to treat a load of laundry articles while carrying the removable basket assembly in a manner described above, without the steps involved with treating articles within the second basket 22.

Figure 3:
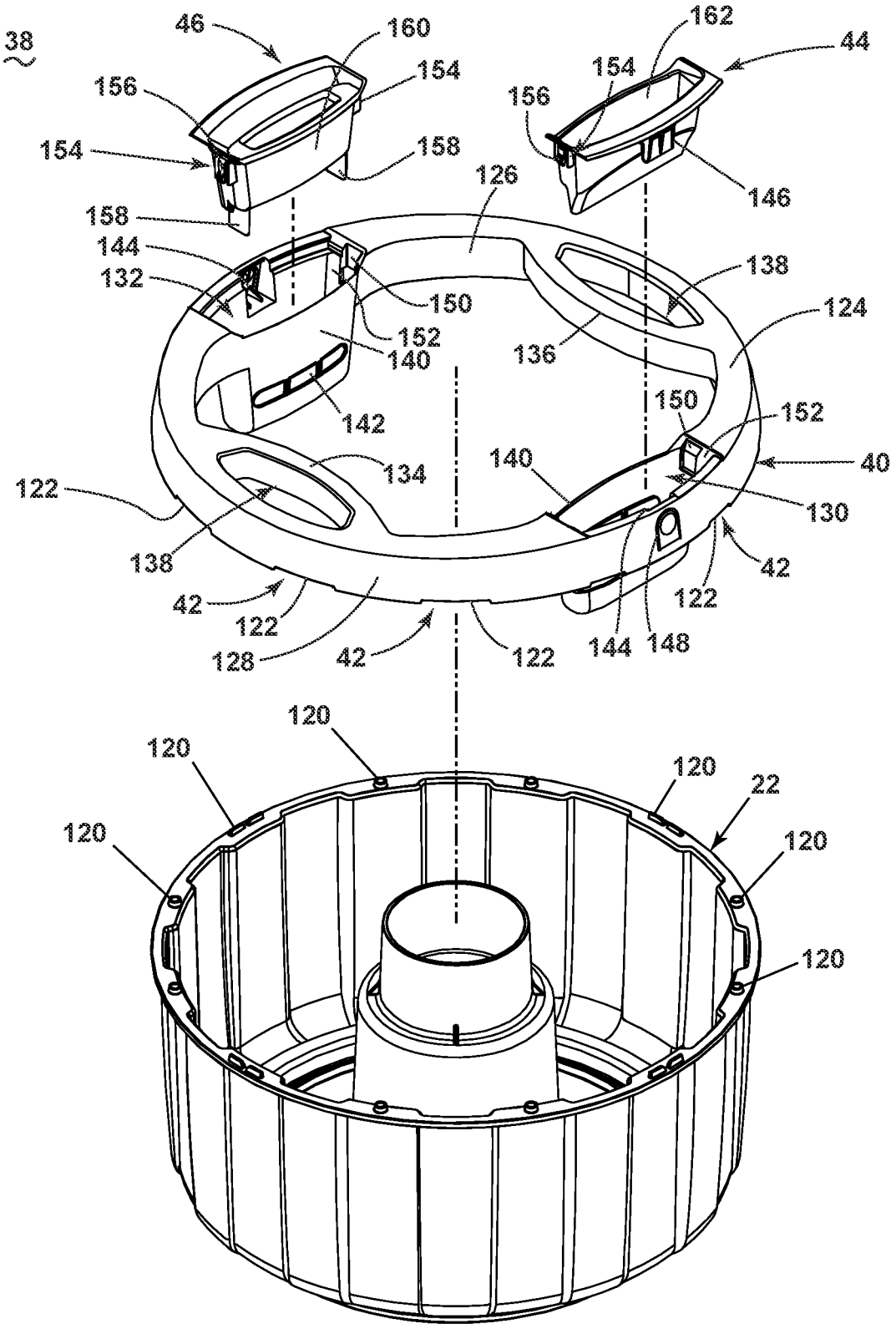
FIG. 3 is an exploded view of the first basket of FIG. 1 including an upper ring a first dispenser, and a centrifugal dispenser exploded from the first basket.

Referring now to FIG. 3 the removable basket assembly 38 includes the second basket 22 having a plurality of mounts or fasteners 120 adapted to align and secure the upper ring 40 to the second basket 22. A set of channels 122 are formed in the upper ring 40 and can at least partially form the outlets 42 between the upper ring 40 and the second basket 22 to provide for draining liquid from the second basket 22. Such draining from the second basket 22 occurs through centrifugal forces imparted on liquids within the second basket 22 through rotation of the second basket 22. The liquid is driven radially outward and to the outlets 42 defined by the channels 122, where the water is driven out of the second basket 22 to drain.

The upper ring 40 can include a top wall 124 connected between an inner wall 126 and an outer wall 128. The detergent dispenser 44 and the centrifugal dispenser 46 can include a first dispenser container 130 and a second dispenser container 132, respectively. The first and second dispenser containers 130, 132 can be formed in the top wall 124, and can be positioned opposite of one another about the upper ring 40. The dispenser containers 130, 132 can include an inner wall 140. An aperture, arranged as a set of apertures 142 are provided in the inner wall 140 providing fluid communication between the second basket 22 and the dispenser containers 130, 132. A first handle 134 and a second handle 136 can be provided in the top wall 124 of the outer ring 40, spaced between the first and second dispenser containers 130, 132, and positioned opposite of one another. A handle aperture 138 can be provided in the first and second handles 134, 136 to facilitate gripping of the removable basket assembly 38.

The centrifugal dispenser 46 can further include a first body 160 adapted to be received within the second dispenser container 132 and the detergent dispenser 44 can further include a second body 162 adapted to be received within the first dispenser container 130. An attachment slot 144 can be provided in the dispenser containers 130, 132. A locking member 146, provided on the dispenser bodies 160, 162, and can be adapted to be received in the attachment slot 144 to releasably secure the dispenser bodies 160, 162 within the dispenser containers 130, 132. A release button 148 can be provided on the upper ring 40 adjacent each of the dispenser containers 130, 132 adapted to release the inserted dispenser bodies 160, 162 from the respective dispenser containers 130, 132. The locking member 146, when used with the attachment slot 144, can help prevent unintended dislocation of the dispenser bodies 160, 162 during operation of the laundry treating appliance 10. Guide slots 150 can also be formed along sidewalls 152 of the dispenser containers 130, 132. Guides 154 can be provided on the dispenser bodies 160, 162 adapted to insert along the guide slots 150 to further secure and align the dispenser bodies 160, 162 within the dispenser containers 130, 132. A spring element, such as spring finger 156 can be provided at the guides 154 to provide a spring force to further retain the dispenser bodies 160, 162 within the dispenser containers 130, 132. Legs 158 can be extend from one or more of the second body 162, providing support or proper spacing within the dispenser containers 130, 132.

The dispenser containers 130, 132 can be similar or identical to one another, while it is contemplated that each dispenser container 130, 132 can be tailored to a particular dispenser body 160, 162. For example, the first dispenser body 160 can be tailored to the centrifugal dispenser 46. Indicia can be included on the upper ring 40, for example, to communicate to a user the proper dispenser to be inserted at the proper dispenser container 130, 132. Additionally, the connection between the second container 132 and the first body 160 can be keyed to prevent incorrect connection between the different dispensers 44, 46.

Figure 4:
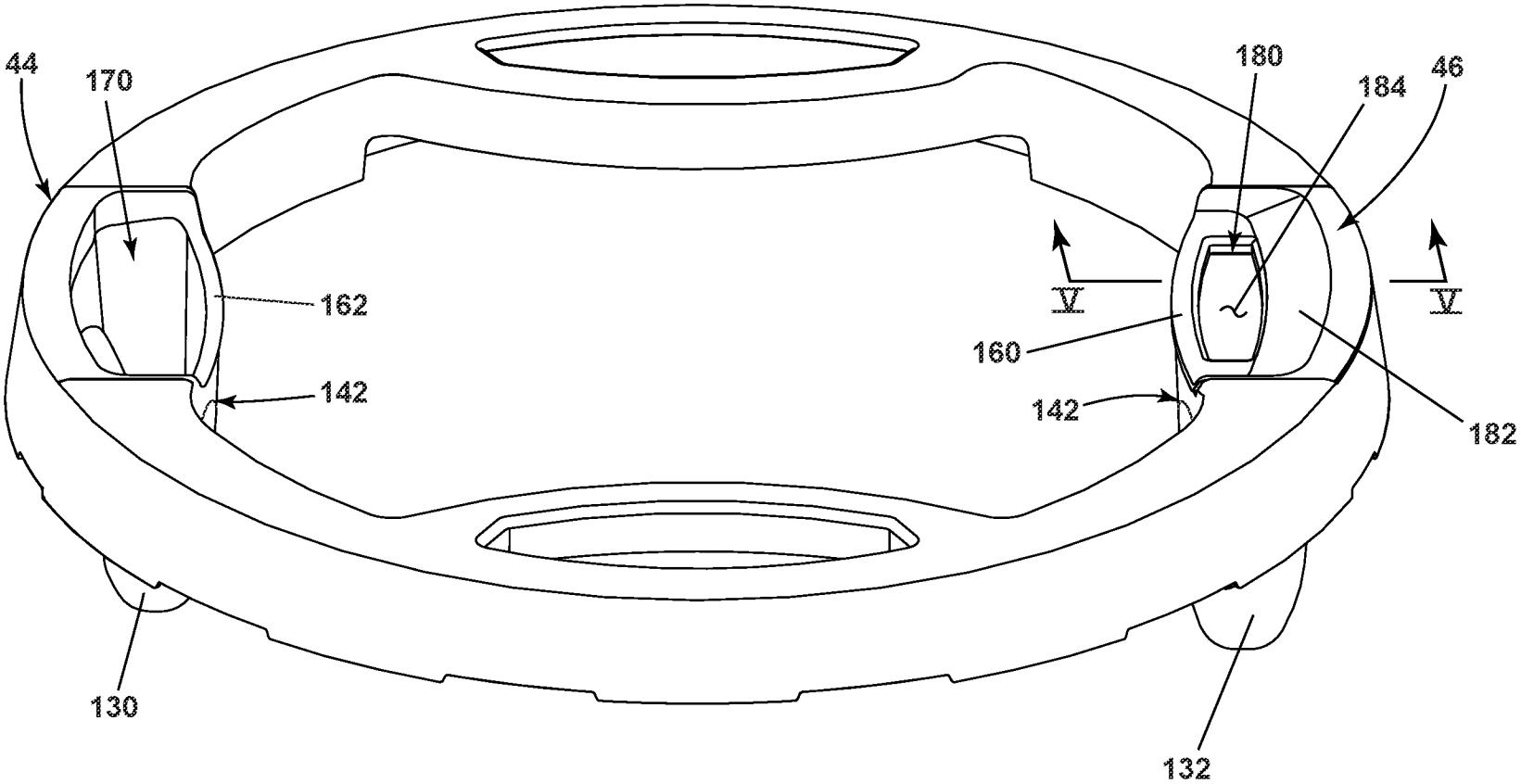
FIG. 4 is a perspective view of the upper ring assembled with the dispensers of FIG.

Referring now to FIG. 4, the detergent dispenser 44 includes the second body 162 provided in the first dispenser container 130 and the centrifugal dispenser 46 includes the first body 160 provided in the second dispenser container 132, while the particular organization is by way of example only. The detergent dispenser 44 includes a first opening 170 adapted to receive treating chemistry, such as detergent, while any treating chemistry, such as bleach, could also be contemplated. The first opening 170 can be in fluid communication with the set of apertures 142 on the first dispenser container 130, in order to provide any inserted treating chemistry or detergent to the first basket 22 through the set of apertures 142.

The centrifugal dispenser 46 includes a dispenser opening 180 and a cover 182 at least partially defining the dispenser opening 180. The dispenser opening 180 can be smaller than the first opening 170, as defined by the cover 182. In one example, indicia can be placed on the cover 182 indicating acceptable types of treating chemistry for the centrifugal dispenser 46, such as fabric softener. The dispenser opening 180 provides access to the interior 184 of the centrifugal dispenser 46 to accept the insertion of treating chemistry to be held and ultimately dispensed into the first basket 22.

Figure 5:
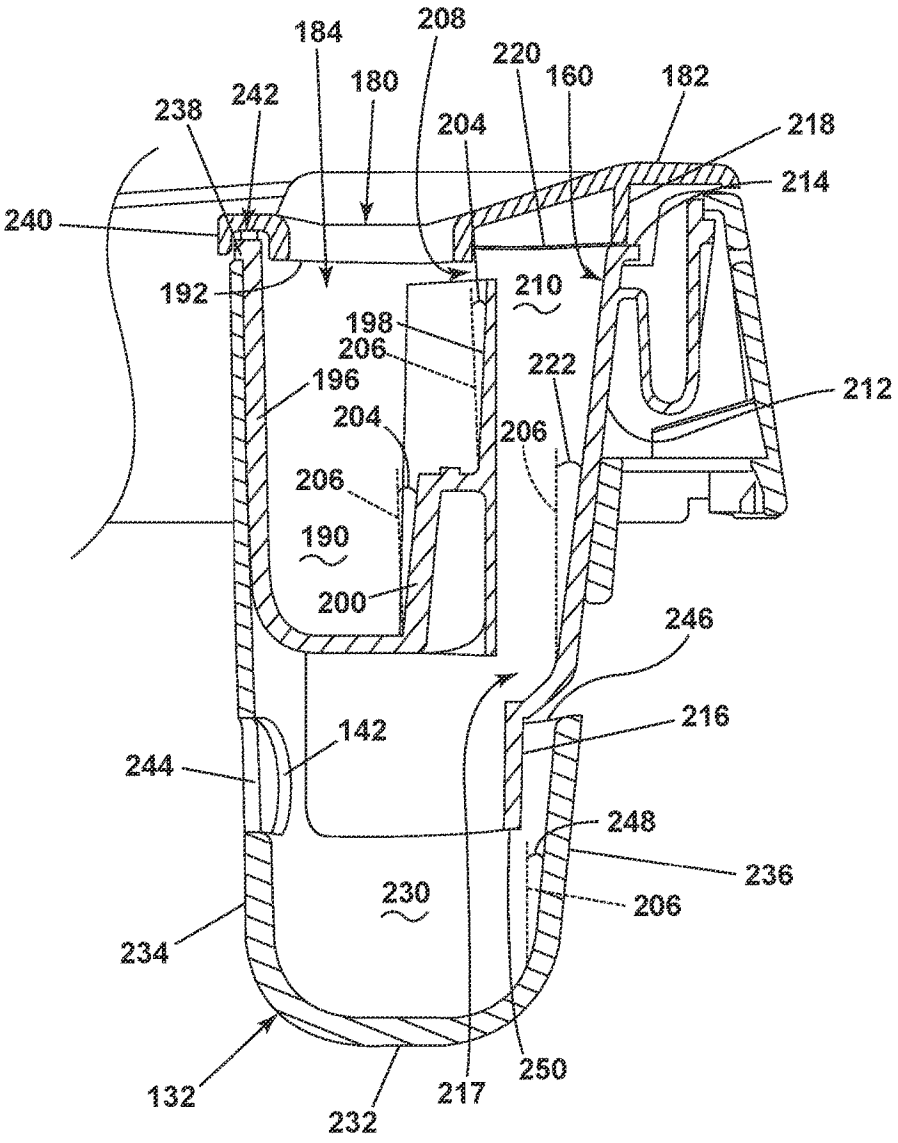
FIG. 5 is a sectional view of the upper ring of FIG. 4 taken along section V-V through the centrifugal dispenser.

Referring now to FIG. 5, taken across section V-V of FIG. 4, the interior 184 of the centrifugal dispenser 46 includes the first body 160 mounted within the second dispenser container 132. The first body 160 defines a holding pocket 190 positioned underneath the dispenser opening 180. A lip 192 is provided on the cover 182 extending toward the holding pocket 190 to direct any inserted treating chemistry into the holding pocket 190. The first body 160 defining the holding pocket 190 further includes interior holding wall 196 and a first radial outer wall 198. The first radial outer wall 198 can include a stepped profile, including a step 200. The step 200 can be representative of different volumes or types of treating chemistry, which can be tailored to a particular intended cycle of operation. The first radial outer wall 198 can be oriented at a first angle 204, relative to a vertical axis 206, which can be parallel to the rotational axis 91 of FIG. 1. The first angle 204 can be between 2 and 10-degrees, and can be 5-degrees in one non-limiting example, while any angle between 1-degree and 89-degrees is contemplated. The first radial outer wall 198 can further be positioned underneath the cover 182, outside of the lip 192, which can be determined by the angled orientation of the first radial outer wall 198. The first radial outer wall 198 can at least partially define a first centrifugal outlet 208.

The first body 160 can further define a transfer pocket 210 in fluid communication with the holding pocket 190 via the first centrifugal outlet 208. The transfer pocket 210 can be located radially outside of the holding pocket 190. An outer transferring wall 212 can include an upper edge 214 and a lower end 216 that at least partially forms a drain outlet 217. The drain outlet 217 can be located at the bottom of the transfer pocket 210. The outer transferring wall 212 can be oriented at a second angle 222 relative to the vertical axis 206. The second angle 222 can be between five degrees and fifteen degrees, and can be ten degrees in one non-limiting example. It should be appreciated that the second angle 222 can be between one degree and eighty-nine degrees. The cover 182 can include a flange 218 extending to the upper edge 214. The cover 182 can seal to the first body 160 at a seam 220 at the junction between the flange 218 and the upper edge 214 to seal the upper extend of the transfer pocket 210.

The second dispenser container 132 can define a dilution pocket 230 bounded by a bottom wall 232, an inner dilution wall 234, and an outer dilution wall 236. The dilution pocket 230 can be positioned vertically beneath the holding pocket 190. The inner dilution wall 234 can extend upwards and partially along the first radial outer wall 198, terminating at an upper edge 238. The cover 182 can include an inner flange 240 to form a channel 242 to seal along the upper edge 238. The set of apertures 142, separated by a rib 244, can be provided in the inner dilution wall 234 to fluidly couple the dilution pocket 230 to the second treating chamber 24 of FIG. 1. As such, the set of apertures 142 can form a dilution pocket inlet. The inner dilution wall 234 transitions to the bottom wall 232, which transitions to the outer dilution wall 236 to bound the dilution pocket 230. A second centrifugal outlet 246 can be formed by the outer dilution wall 234 spaced from the outer transferring wall 212, fluidly coupling the dilution pocket 230 to the second treating chamber 24 of FIG. 1, opposite of the set of apertures 142. The dilution pocket inlet, or the set of apertures 142, can be located below the second centrifugal outlet 246 relative to a radius defined by the rotational axis 91 of FIG. 1. The outer dilution wall 236 can be oriented at a third angle 248 relative to the vertical axis 206. At least a portion of the outer dilution wall 236 can abut the outer transferring wall 212. The first body 160 can mount to the second dispenser container 132 at the abutting walls, such as fastening the inner dilution wall 234 to the interior holding wall 196.

Figure 6:
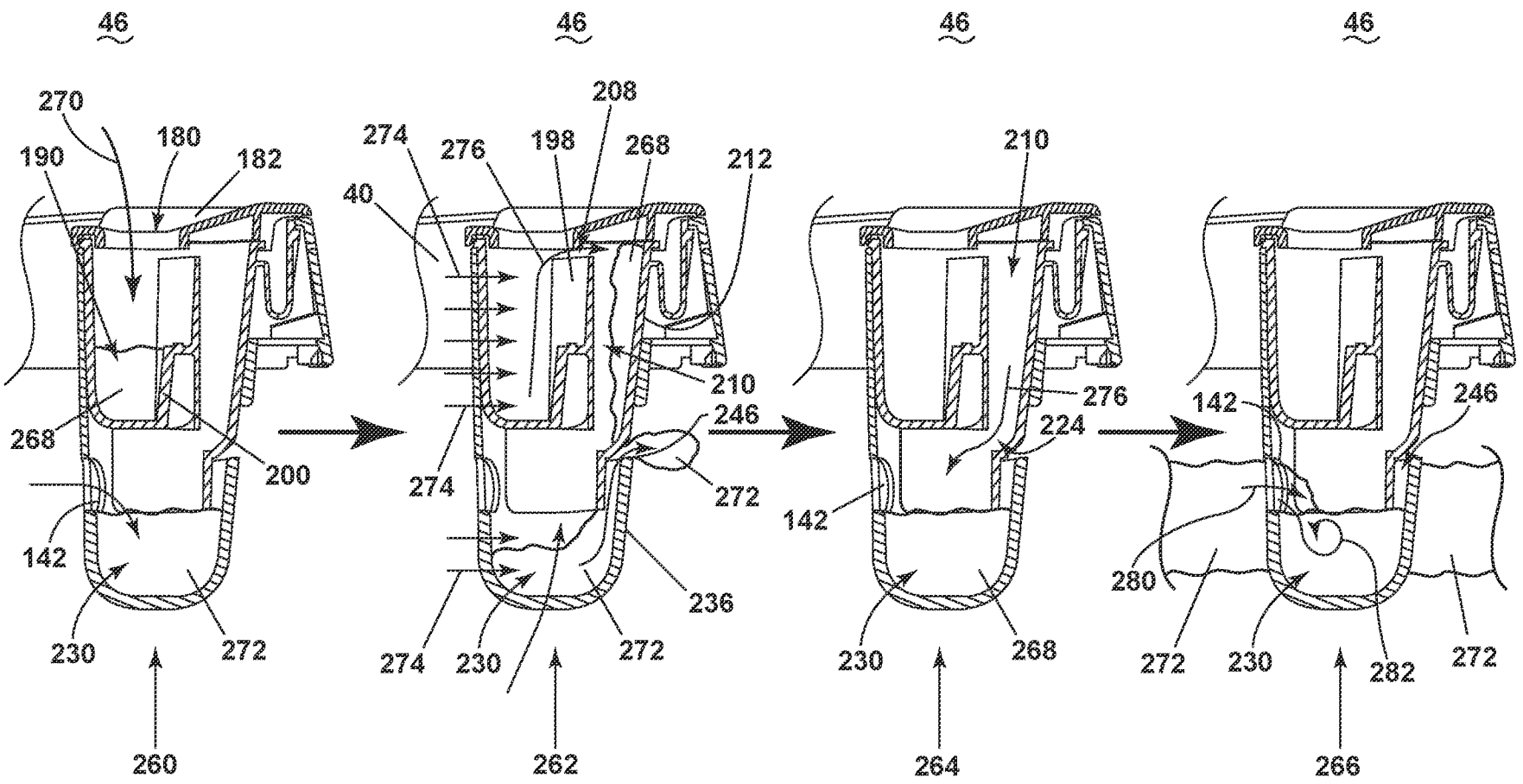
FIG. 6 is a schematic flow chart representing the flow path of a volume of treating chemistry provided in the centrifugal dispenser.

Referring now to FIG. 6, the operation of the centrifugal dispenser 46 is represented as a flow chart, including a first step 260, a second step 262, a third step 264, and a fourth step 266. At the first step 260, the user can provide a volume of treating chemistry 268, such as fabric softener, to the centrifugal dispenser 46 through the opening 180 in the cover 182 to at least partially fill the holding pocket 190, shown by arrow 270. As shown, the treating chemistry 268 is filled up to the top of the step 200, which can be used in properly measuring the treating chemistry 268. During the first step 260, a cycle of operation can also fill the treating chamber with a volume of water 272 or liquid. The water 272 fills the treating chamber and can pass through the set of apertures 142 into the dilution pocket 230, where a volume of water 272 can remain.

At the second step 262, a spin cycle can begin as part of the cycle of operation. A centrifugal or inertial force, represented by arrows 274, can be imparted to the treating chemistry 268 and the water 272. Resultant of the direction of the centrifugal force 274 and the angled disposition of the first radial outer wall 198, the treating chemistry 268 can pass along the first radial outer wall 198 into the transfer pocket 210 through the first centrifugal outlet 208, represented by arrow 276. Simultaneously, the centrifugal or inertial force 274 is imparted to the water 272 in the dilution pocket 230. Resultant of the direction of the centrifugal force 274 and the angled disposition of the outer dilution wall 236, the water 272 is driven through the second centrifugal outlet 246 where the water can exit the centrifugal dispenser 46 through the second centrifugal outlet 246. As such, the holding pocket 190 and the dilution pocket 230 are emptied, and the continuing centrifugal or inertial force of the rotating upper ring 40 holds the treating chemistry within the transfer pocket 210 along the outer transferring wall 212.

At the third step 264, the spin cycle can slow or stop, which decreases or removes any centrifugal force acting upon the treating chemistry 268. Gravity can permit the treating chemistry 268 to drain from the transfer pocket 210 into the dilution pocket 230 through the outlet 224, represented by arrow 276. Removal of the water 272 from the dilution pocket 230 prior to providing the treating chemistry 268 to the dilution pocket 230 prevents any unwanted or premature spilling of the treating chemistry 268 through the set of apertures 142 due to excess liquid within the dilution pocket 230.

At the fourth step 266, another fill cycle, such as a rinse cycle can begin and fill the second treating chamber 24 of FIG. 1 with water 272. The water 272 can rise to a level within the second treating chamber 24 such that it can enter through at least the set of aperture 142 as well as the second centrifugal outlet 246 if the water level is high enough. The water 272 can enter into the dilution pocket 230, at arrow 280, and mix with the treating chemistry, at arrow 282. Mixing in this manner provides for improved dilution of the treating chemistry for application to the laundry, where such dilution is beneficial, such as with fabric softener. Furthermore, this system provides for the removal of any residual water within the dispenser from the initial wash or fill cycle, which prevents premature, unintended exposure of the treating chemistry to the load.

Figure 7:
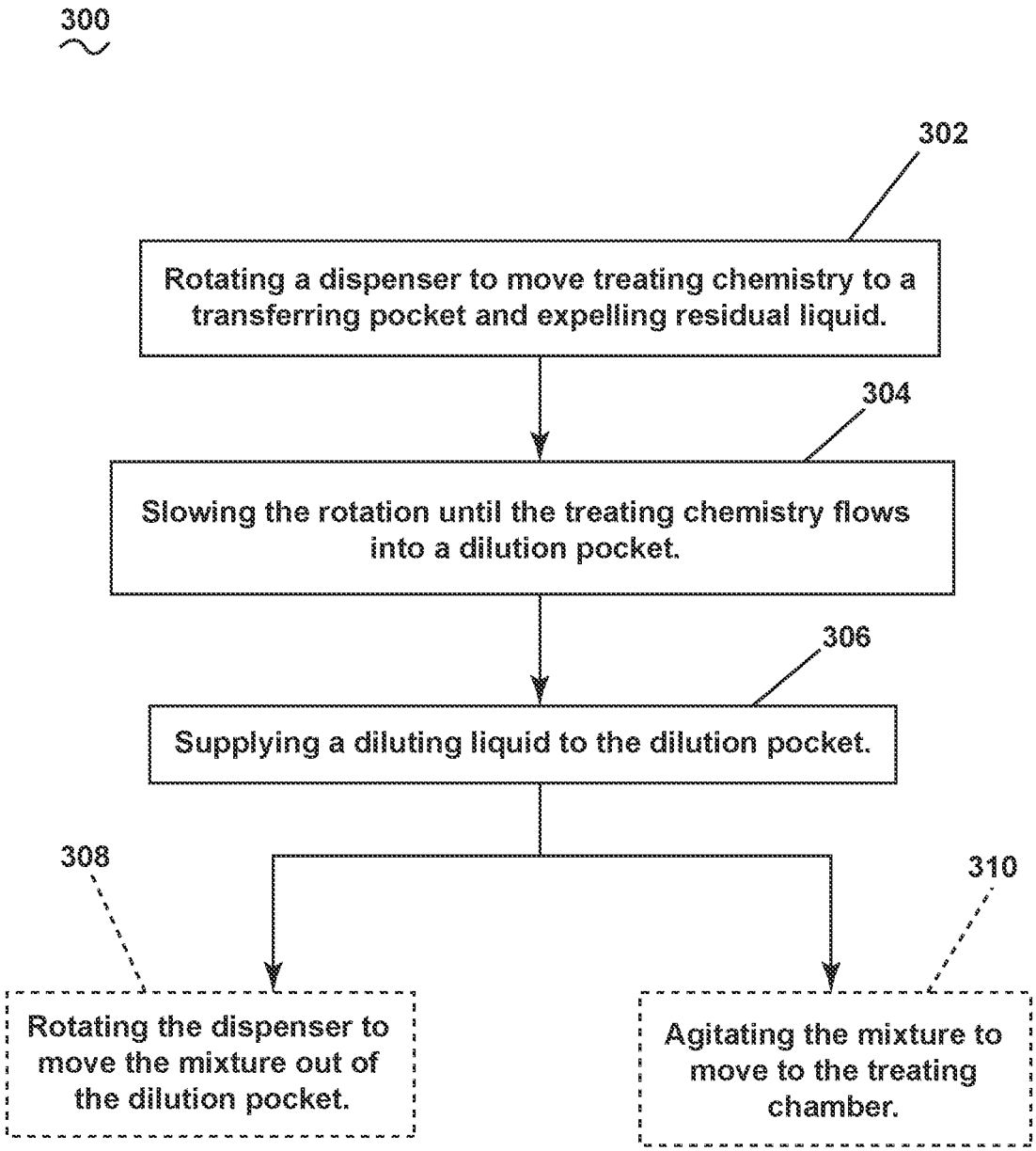
FIG. 7 is a flow chart illustrating a method of dispensing treating chemistry using centrifugal force.

Referring now to FIG. 7, a method 300 can include, at 302, rotating a dispenser at a speed great enough such that centrifugal forces moves treating chemistry from a holding pocket to a transferring pocket while expelling residual liquid from a dilution pocket. The treating chemistry can move from the holding pocket to the transferring pocket through a first centrifugal outlet. Expelling of residual liquid in the dilution pocket can occur through a second centrifugal outlet in the dilution pocket. The holding pocket, transferring pocket, and dilution pockets can be those as described herein. The method 300 can further include, at 304, slowing the rotation of the dispenser until the treating chemistry flows by gravity into a dilution pocket. Slowing can occur, for example, at the decline or end of a spin cycle of the cycle of operation. The slowing rotation reduces the centrifugal force acting on the treating chemistry, allowing gravity to draw the treating chemistry into the dilution pocket.

At 306, the method 300 can further include supplying a diluting liquid to the dilution pocket to form a mixture with the treating chemistry. The diluting liquid, in one non-limiting example, can include water. The water can be supplied to the dilution pocket during a fill or a rinse cycle after the first spin cycle.

At 308, the method 300 can optionally include rotating the dispenser at a speed great enough such that centrifugal force moves the mixture out of the dilution pocket. A second spin cycle can draw the mixture out of the dilution pocket through the second centrifugal outlet.

At 310, the method 300 can optionally include agitating the mixture until the dilution mixture in the dilution pocket moves to the treating chamber. For example, a rinse cycle including agitation for a treating chamber having a volume of liquid sufficient to fill the dilution pocket can be used to mix and draw out the treating chemistry intermixed with the dilution liquid.

The apparatus and method as described herein provide for centrifugally dispersing a volume of treating chemistry within a basket mixed with a dilution liquid such as water. The ability to mix the treating chemistry with the dilution liquid at a desired interval during a cycle of operation can provide the treating chemistry to the laundry indirectly, where direct application can otherwise damage the laundry. Expelling the residual liquid through the second centrifugal outlet prevents premature passing or spilling of the treating chemistry onto the laundry, which can provide for improve application of the treating chemistry.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A laundry treating appliance, comprising:

a tub defining a liquid chamber;

at least one basket assembly defining a laundry chamber and having an open top, the at least one basket assembly having an upper ring secured to the basket assembly for rotation with the basket assembly, the upper ring defining a top wall with a dilution pocket formed in the top wall and having a dilution pocket centrifugal outlet fluidly coupled to at least one of the liquid chamber or the laundry chamber; and a centrifugal dispenser adapted to be received within the dilution pocket, the centrifugal dispenser including a holding pocket having a radially outer wall at least partially defining a holding pocket centrifugal outlet and a transfer pocket located radially exterior of the holding pocket and defined in part by an outer transferring wall spaced from the radially outer wall, the transfer pocket having at least a portion fluidly coupled to the holding pocket centrifugal outlet, wherein the transfer pocket includes a drain outlet fluidly coupled to the dilution pocket.

2. The laundry treating appliance of claim 1, wherein the at least one basket assembly comprises an interior basket at least partially provided within an open top of a first basket.

3. The laundry treating appliance of claim 1, further comprising a clothes mover provided within the liquid chamber and rotatably coupled to a motor.

4. The laundry treating appliance of claim 3 wherein the at least one basket assembly is at least partially mounted on the clothes mover.

5. The laundry treating appliance of claim 1, further comprising a step provided in the radially outer wall.

6. The laundry treating appliance of claim 1 wherein a first body defines the holding pocket and the transfer pocket and a second container defines the dilution pocket and the first body is received within the second container.

7. The laundry treating appliance of claim 1, further comprising a motor adapted to provide a driving force to rotate the at least one basket assembly about a rotational axis.

8. The laundry treating appliance of claim 7 wherein the radially outer wall is provided at a first angle relative to the rotational axis.

9. The laundry treating appliance of claim 8 wherein the outer transferring wall extends at least partially into the dilution pocket, the outer transferring wall is provided at a second angle relative to the rotational axis, and the outer transferring wall at least partially forms the drain outlet.

10. The laundry treating appliance of claim 7 wherein the dilution pocket further comprises an inner dilution wall and an outer dilution wall, that is radially exterior from the inner dilution wall and wherein the dilution pocket further comprises a dilution pocket inlet within the inner dilution wall.

11. The laundry treating appliance of claim 10 wherein the dilution pocket centrifugal outlet is at least partially formed by the outer dilution wall and wherein the dilution pocket inlet is located below the dilution pocket centrifugal outlet relative to a radius extending from the rotational axis.

12. A laundry treating appliance, comprising:

a tub defining a liquid chamber;

a first basket defining a laundry chamber and having an open top; and a centrifugal dispenser carried by and secured to the first basket for rotation with the first basket, the centrifugal dispenser comprising:

a holding pocket having a radially outer wall at least partially defining a first centrifugal outlet;

a transfer pocket located radially exterior of the holding pocket and defined in part by an outer transferring wall spaced from the radially outer wall of the holding pocket, the transfer pocket having at least a portion fluidly coupled to the first centrifugal outlet, wherein the transfer pocket has a drain outlet; and a dilution pocket defined at least in part by an inner dilution wall and an outer dilution wall, that is radially exterior from the inner dilution wall, the dilution pocket fluidly coupled to the drain outlet and having a second centrifugal outlet at least partially formed by the outer dilution wall, the second centrifugal outlet fluidly coupled to at least one of the liquid chamber and the laundry chamber, wherein a first body defines the holding pocket and the transfer pocket and a second container defines the dilution pocket and the first body is received within the second container.

13. The laundry treating appliance of claim 12 wherein the holding pocket is positioned vertically above the dilution pocket.

14. The laundry treating appliance of claim 12 wherein the drain outlet is located at a bottom of the transfer pocket and at least partially defined by the outer transferring wall.

15. The laundry treating appliance of claim 12, further comprising a second basket and wherein the first basket is at least partially provided within an open top of the second basket.

16. The laundry treating appliance of claim 15, further comprising a motor adapted to provide a driving force to rotate the second basket about a rotational axis.

17. The laundry treating appliance of claim 12 wherein the centrifugal dispenser further comprises a cover at least partially forming the holding pocket and having an opening adapted to receive treating chemistry.

18. The laundry treating appliance of claim 17 wherein the cover further includes a lip defining the opening and at least partially defining the first centrifugal outlet.

19. The laundry treating appliance of claim 12 wherein the outer transferring wall is spaced from the outer dilution wall and the second centrifugal outlet is defined therebetween.

20. The laundry treating appliance of claim 1 wherein the upper ring further defines an inner wall and an outer wall, the top wall connected between the inner wall and the outer wall such that the dilution pocket formed in the top wall is positioned between the inner wall and the outer wall.

* * * * *